US010123138B2

(12) United States Patent
Gustafsson

(10) Patent No.: US 10,123,138 B2
(45) Date of Patent: Nov. 6, 2018

(54) MICROPHONE ISOLATION IN A BONE CONDUCTION DEVICE

(71) Applicant: Cochlear Limited, Macquarie University (AU)

(72) Inventor: Johan Gustafsson, Göteborg (SE)

(73) Assignee: Cochlear Limited, Macquarie University (AU)

( * ) Notice: Subject to any disclaimer, the term of this patent is extended or adjusted under 35 U.S.C. 154(b) by 0 days.

(21) Appl. No.: 15/219,614

(22) Filed: Jul. 26, 2016

(65) Prior Publication Data

US 2018/0035219 A1 Feb. 1, 2018

(51) Int. Cl.
*H04R 25/00* (2006.01)

(52) U.S. Cl.
CPC ..... *H04R 25/606* (2013.01); *H04R 25/65* (2013.01)

(58) Field of Classification Search
CPC ..... H04R 25/606
USPC ..... 381/326, 6, 68.4, 92, 111–115, 122, 151, 381/355, 369, 380; 607/57; 600/25
See application file for complete search history.

(56) References Cited

U.S. PATENT DOCUMENTS

| | | | | |
|---|---|---|---|---|
| 8,565,461 | B2 | 10/2013 | Asnes | |
| 2009/0245553 | A1 | 10/2009 | Parker | |
| 2012/0083860 | A1* | 4/2012 | Hakansson | H04R 1/288 607/57 |
| 2012/0088956 | A1 | 4/2012 | Asnes et al. | |
| 2013/0096367 | A1* | 4/2013 | Easter | A61F 11/045 600/25 |
| 2015/0063616 | A1 | 3/2015 | Westerkull | |
| 2016/0234613 | A1 | 8/2016 | Westerkull | |

* cited by examiner

*Primary Examiner* — Md S Elahee
(74) *Attorney, Agent, or Firm* — Edell, Shapiro & Finnan, LLC

(57) ABSTRACT

Presented herein are transcutaneous bone conduction devices having seismic mass actuators that impart vibration to a recipient's skull via relative movement of an associated seismic mass and a coupling mass. The vibration may be generated based on sound signals received at one or more microphones that are suspended from the seismic mass.

20 Claims, 8 Drawing Sheets

MICROPHONE ISOLATION IN A BONE CONDUCTION DEVICE

BACKGROUND

Field of the Invention

The present invention relates generally to bone conduction devices.

Related Art

Hearing loss, which may be due to many different causes, is generally of two types: conductive and sensorineural. Sensorineural hearing loss is due to the absence or destruction of the hair cells in the cochlea that transduce sound signals into nerve impulses. Various hearing prostheses are commercially available to provide individuals suffering from sensorineural hearing loss with the ability to perceive sound. For example, cochlear implants use an electrode array implanted in the cochlea of a recipient to bypass the mechanisms of the ear. More specifically, an electrical stimulus is provided via the electrode array to the auditory nerve, thereby causing a hearing percept.

Conductive hearing loss occurs when the normal mechanical pathways that provide sound to hair cells in the cochlea are impeded, for example, by damage to the ossicular chain or ear canal. Individuals suffering from conductive hearing loss may retain some form of residual hearing because the hair cells in the cochlea may remain undamaged.

Individuals suffering from conductive hearing loss typically receive an acoustic hearing aid. Hearing aids rely on principles of air conduction to transmit acoustic signals to the cochlea.

In particular, a hearing aid typically uses an arrangement positioned in the recipient's ear canal or on the outer ear to amplify a sound received by the outer ear of the recipient. This amplified sound reaches the cochlea causing motion of the perilymph and stimulation of the auditory nerve.

In contrast to hearing aids, which rely primarily on the principles of air conduction, certain types of hearing prostheses, commonly referred to as bone conduction devices, convert a received sound into vibrations. The vibrations are transferred through the skull to the cochlea causing generation of nerve impulses, which result in the perception of the received sound. Bone conduction devices are suitable to treat a variety of types of hearing loss and may be suitable for individuals who cannot derive sufficient benefit from acoustic hearing aids, cochlear implants, etc., or for individuals who suffer from stuttering problem

SUMMARY

In one aspect, a transcutaneous bone conduction device is provided. The transcutaneous bone conduction device comprises: a housing; a coupling mass configured to be attached to a recipient; a seismic mass actuator configured to generate vibration for delivery to the recipient based on the sound signals received at the microphone, wherein the actuator comprises a seismic mass configured for relative movement with the coupling mass to generate the vibration; and at least one housing suspension mechanism coupled to the housing and the seismic mass so that the housing is suspended from the seismic mass.

In another aspect, a bone conduction device is provided. The bone conduction device comprises: a microphone, and first and second actuator subassemblies configured for relative movement in order to impart vibration to a recipient, wherein the second actuator subassembly comprises a counterweight to which the microphone is mechanically coupled.

In another aspect, a passive transcutaneous bone conduction device is provided. The passive transcutaneous bone conduction device comprises: a housing; an actuator disposed within the housing and configured to generate vibration for delivery to a recipient; and a coupling mass connected to the actuator and configured to be held against the skin of a recipient to deliver the vibration from the actuator to the recipient, wherein there are at least two suspension mechanisms disposed in series between the coupling mass and the housing.

BRIEF DESCRIPTION OF THE DRAWINGS

Embodiments of the present invention are described herein in conjunction with the accompanying drawings, in which.

DETAILED DESCRIPTION

Embodiments presented herein are generally directed to transcutaneous bone conduction devices having a seismic mass actuator that imparts vibration to a recipient's skull via relative movement of an associated seismic mass component (seismic mass) and a coupling mass component (coupling mass). The vibration may be generated based on sound signals received at one or more microphones that are suspended from the seismic mass. That is, transcutaneous bone conduction devices in accordance with embodiments presented herein comprise a suspension mechanism that is used to attach the one or more microphones, either directly or indirectly, to the seismic mass of the seismic mass actuator. The suspension mechanism is configured to decouple the microphones from the vibration generated by the relative movement of the seismic mass and the coupling mass.

Figure 1:
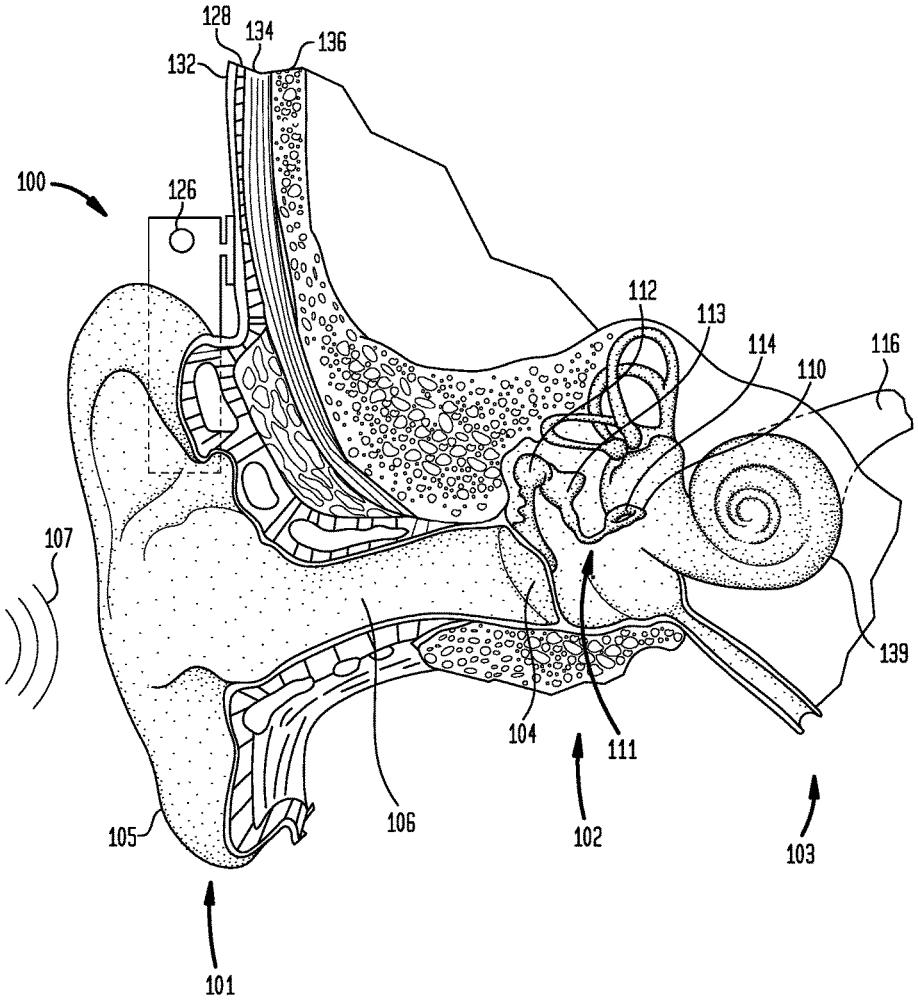
FIG. 1 is a perspective view of an exemplary transcutaneous bone conduction device in accordance with embodiments presented herein.

FIG. 1 is a perspective view of a transcutaneous bone conduction device 100 in accordance with embodiments presented herein. The bone conduction device 100 is worn by a recipient adjacent to the recipient's outer ear 101. Also shown in FIG. 1 is the recipient's middle ear 102 and inner ear 103. Elements of outer ear 101, middle ear 102, and inner ear 103 are described below, followed by a description of bone conduction device 100.

In a fully functional human hearing anatomy, outer ear 101 comprises an auricle 105 and an ear canal 106. A sound wave or acoustic pressure 107 is collected by auricle 105 and channeled into and through ear canal 106. Disposed across the distal end of ear canal 106 is a tympanic membrane 104 which vibrates in response to acoustic wave 107. This vibration is coupled to oval window or fenestra ovalis 110 through three bones of middle ear 102, collectively referred to as the ossicles 111 and comprising the malleus 112, the incus 113 and the stapes 114. The ossicles 111 of middle ear 102 serve to filter and amplify acoustic wave 107, causing oval window 110 to vibrate. Such vibration sets up waves of fluid motion within cochlea 139. Such fluid motion, in turn, activates hair cells (not shown) that line the inside of cochlea 139. Activation of the hair cells causes appropriate nerve impulses to be transferred through the spiral ganglion cells and auditory nerve 116 to the brain (not shown), where they are perceived as sound.

FIG. 1 illustrates the positioning of the bone conduction device 100 relative to outer ear 101, middle ear 102 and inner ear 103 of the recipient. As shown, bone conduction device 100 is positioned behind outer ear 101 of the recipient and comprises one or more sound input elements, such as one or more microphones 126, that are configured to receive sound signals. In addition to microphones 126, the bone conduction device 100 may include other sound input elements, such as a telecoil, an audio port, etc.

Bone conduction device 100 also comprises a sound processor, a seismic mass actuator that includes a seismic mass component, and various other operational components, all of which have been omitted from FIG. 1 for ease of illustration. In operation, the microphone(s) 126 (and/or other sound input elements) convert received sound signals into electrical signals that are processed by the sound processor. The sound processor then generates, based on the signals received form the sound input elements, control signals which cause the seismic mass actuator to generate mechanical motion of one or more components and, accordingly, impart vibration to the recipient's skull bone (skull) 136. As described further below, in accordance with the embodiments presented herein, the one or more microphones 126 of bone conduction device 100 are suspended, either directly or indirectly, from a seismic mass component/assembly (seismic mass) of the transcutaneous bone conduction device via a suspension mechanism, which is sometimes referred to herein as a housing suspension mechanism. That is, the housing suspension mechanism is configured to suspend the housing from the seismic mass and, since the microphones 126 are disposed on the housing, the housing suspension mechanism vibrationally isolates the one or more microphones 126 from the vibration imparted to the recipient's skull by the seismic actuator. As used herein, isolation of the microphone 126 from the vibration imparted to the recipient's skull (i.e., vibration generated by the seismic mass actuator of the bone conduction device) refers to a mechanical decoupling such that vibration does not affect operation of the microphones. Stated differently, the isolation substantially reduces vibrationally-induced feedback at the microphone 126.

As illustrated, bone conduction device 100 further includes a coupling mass 140 configured to attach the bone conduction device to the recipient. In the embodiment of FIG. 1, coupling mass 140 is configured to be attached, via a transcutaneous magnetic field, to an implanted anchor system (not shown) fixed to the recipient's skull bone 136 (i.e., beneath the recipient's muscle 134, fat 128 and skin 132). That is, the coupling mass 140 includes one or more permanent magnets, and the implanted anchor system, sometimes referred to herein as a fixation system, includes one or more implanted magnetic components that can be magnetically coupled to the permanent magnets in the coupling mass. It will be appreciated that embodiments presented herein may be implemented with other types of coupling masses that operate with other types of anchor systems or without an anchor system. For example, in one arrangement, the coupling mass may be configured to be held against the skin 132 of the recipient using an adhesive. In another example, the coupling mass 140 may be configured to be held against the skin of the recipient using a clamping force generated by a structure extending to the opposite side of the head (e.g., via a headband arrangement). In other words, the embodiments presented herein are applicable to a number of different types of skin-drive (transcutaneous) bone conduction devices, including passive transcutaneous system with implanted magnet(s) or non-surgical solutions that use a soft band, a headband/arch, or adhesive to couple a bone conduction device to a recipient, and/or other types of bone conduction devices, such as bone conduction glasses, etc.

As noted above, in the arrangement of FIG. 1, the seismic mass actuator includes a seismic mass component, sometimes referred to herein simply as a seismic mass. Also as noted above, the one or more microphones 126 are configured to be suspended (e.g., indirectly) from the seismic mass. This specific arrangement is shown in greater detail in FIG. 2A.

Figure 2A:
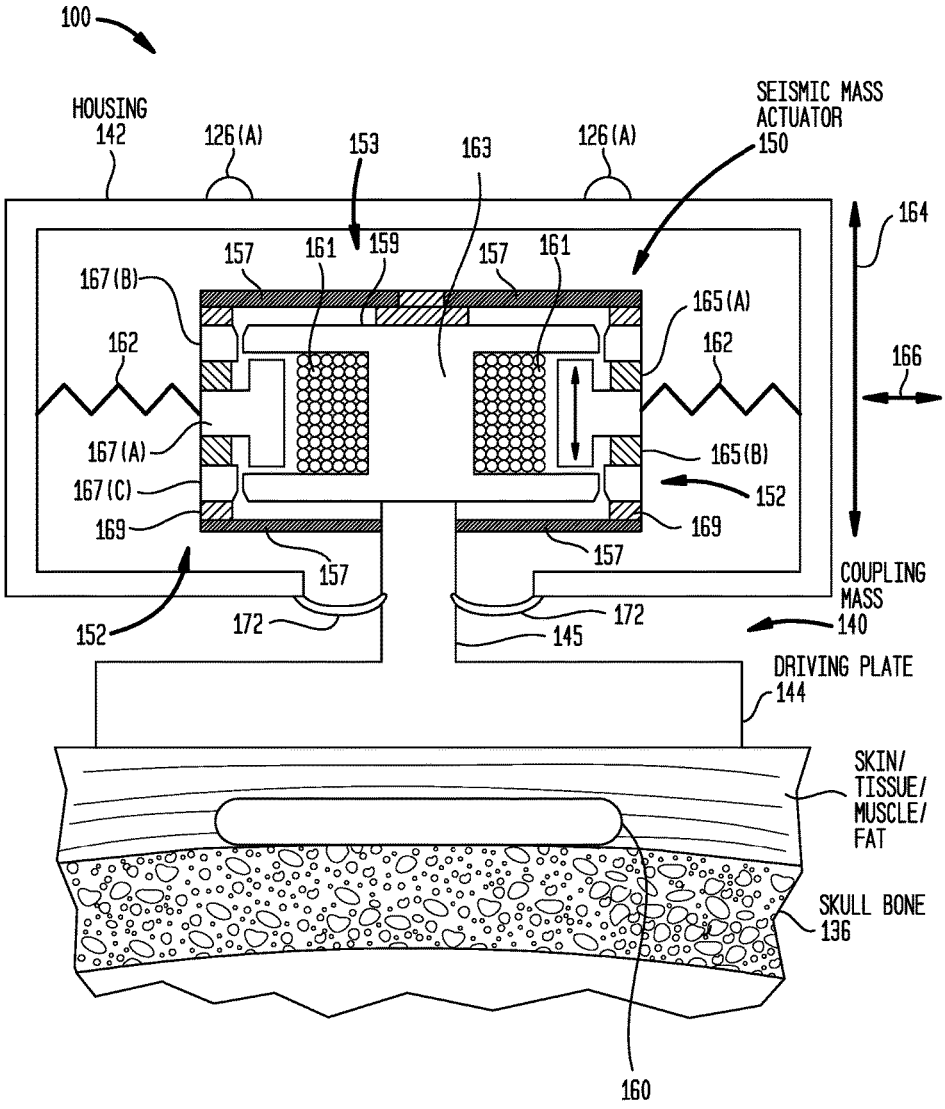
FIGS. 2A-2C are schematic diagrams illustrating components of transcutaneous bone conduction devices in accordance with embodiments presented herein.

More specifically, shown in FIG. 2A is a housing 142 for the bone conduction device 100, a seismic mass actuator 150, the coupling mass 140, and an implanted anchor system 160. Also shown are two microphones 126(A) and 126(B) disposed on the housing 142.

The seismic mass actuator 150 can operate according to a number of different actuation principles in order to impart vibration to a recipient. For example, the seismic mass actuator 150 can be an electromagnetic actuator (i.e., operating based on variable reluctance), a piezoelectric actuator, a magnetostrictive actuator, a floating mass or moving coil actuator, etc. However, in general, regardless of the employed actuation principle, the seismic mass actuator 150 includes a seismic mass 152. In general, the seismic mass 152 may be formed from one or more elements, such as magnets, soft magnetic components, a counterweight, etc., depending on the selected actuation principle. The counterweight is a component of a high-density material that simply adds mass.

In the arrangement of FIG. 2A, the seismic mass actuator 150 is an electromagnetic actuator that includes an output assembly formed by a bobbin assembly 153, the seismic mass 152, and springs 157. Springs 157 connect the bobbin assembly 153 to the seismic mass 152. As illustrated, bobbin assembly 153 includes a bobbin 159, and a coil 161 that is wrapped around a core 163 of the bobbin 159. In the illustrated embodiment, bobbin assembly 153 is radially symmetrical.

The seismic mass 152 illustrated in FIG. 2A comprises permanent magnets 165(*a*) and 165(*b*), yokes 167(A), 167(B), and 167(C), and spacer 169. Spacer 3169 provides a connective support between springs 157 and the other elements of seismic mass 152. Springs 157 permit seismic mass 152 to move relative to bobbin assembly 153 upon interaction of a dynamic magnetic flux, produced by bobbin assembly 153. This dynamic magnetic flux is produced by energizing coil 161 with an alternating current. The static magnetic flux is produced by permanent magnets 165(A) and 165(B) of seismic mass 152. In this regard, the illustrated seismic mass 152 is a static magnetic field generator and the illustrated bobbin assembly 153 is a dynamic magnetic field generator. Coupling apparatus 140 is rigidly connected to bobbin assembly 153.

As noted, bobbin assembly 153 is configured to generate a dynamic magnetic flux when energized by an electric current. In this exemplary embodiment, bobbin 159 is made of a soft iron. Coil 161 may be energized with an alternating current to create the dynamic magnetic flux. The iron of bobbin 159 is conducive to the establishment of a magnetic conduction path for the dynamic magnetic flux. Conversely, seismic mass 152, as a result of permanent magnets 165(A) and 165(A), in combination with yokes 167(A), 167(B), and 167(C), which are made from a soft iron, generate, due to the permanent magnets, a static magnetic flux. The soft iron of the bobbin and yokes may be of a type that increases the magnetic coupling of the respective magnetic fields, thereby providing a magnetic conduction path for the respective magnetic fields.

It is to be appreciated that a bone conduction device, such as bone conduction device 100, includes a number of operational components, such as a sound processor, an amplifier, actuator drive circuitry, a power source, etc., all of which have been omitted from FIG. 2A for ease of illustration. It is also to be appreciated that, depending on the actuation principal of the seismic mass actuator 150, the actuator can include a number of different components used to impart vibration to a recipient's skull.

In the arrangement of FIG. 2A, the coupling mass 140 comprises a driving plate 144 that includes one or more magnetic elements (not shown in FIG. 2A) that are configured to be magnetically coupled to the implanted anchor system 160. That is, the implanted anchor system 160, which is anchored to the recipient's skull bone 136, includes one or magnetic components (i.e., permanent magnets and/or elements formed from a magnetic material) to which the one or more magnetic elements in the driving plate 144 are magnetically attracted so as to retain the bone conduction device 100 on the recipient's head via a transcutaneous magnetic field.

As shown in FIG. 2A, the driving plate 144 is mechanically linked to the seismic mass actuator 150 via a coupling shaft 145. The coupling mass 140 includes the driving plate 144 and shaft 145.

As noted above, the seismic mass actuator 150 can operate according to any one of a number of different types of actuation principles. However, in general, the seismic mass actuator 150 operates by generating a dynamic force (i.e., relative movement) between the seismic mass 152 and the coupling mass 140 that results in vibration that is transcutaneously transmitted to the skull bone 136. The relative movement of the seismic mass 152 and the coupling mass 140 depends on the size differences between these respective masses and the mechanical impedance of the interface between the coupling mass and the head. In the case of the transcutaneous arrangement of FIG. 2A, the coupling mass 140 interfaces with the recipient's skin, which has an associated impedance to vibration that is relatively low when compared to the impedance of the skull bone. Also, in general, the coupling mass 140 is smaller than the seismic mass 152 because high vibrational amplitude of the coupling mass improves system efficiency. The low impedance interface of the coupling mass 140, combined with the relative size differences between the coupling mass 140 and the seismic mass 152, causes the displacement of the seismic mass to be lower than that of the coupling mass. In other words, the movement of the coupling mass 140 is greater than the movement of the seismic mass 152. This is in contrast to percutaneous arrangements where the coupling mass is rigidly connected to the recipient's skull bone (e.g., percutaneous abutment), resulting in less movement of a coupling mass relative to a seismic mass.

As shown in FIG. 2A, the housing 142 is suspended from the seismic mass 152 via a suspensions mechanism, which is sometimes referred to herein as a housing suspension mechanism 162. The illustrated housing suspension mechanism 162 comprises a disc spring with the inner circumference secured to the seismic mass 152 and the outer circumference secured to the housing 142. The housing 142 may contain, or have disposed thereon, other functional components, such as an electronic assembly, user interface, microphone, etc.

The housing suspension mechanism 162 shown in FIG. 2A is disposed in series with an actuator suspension mechanism, which is formed by the springs 157. This means that vibrations passing between the coupling mass 140 and housing 142 via the housing suspension mechanism 162, must also pass through the actuator suspension mechanism (i.e., springs 157). The arrangement of the respective suspension mechanisms shown in FIG. 2A creates an indirect connection between the housing 142 and the coupling mass 140 via two different suspension mechanisms that are in series. This can improve vibrational decoupling between the actuator output and the functional components contained within, or on, the housing (including any microphones). This is in contrast to conventional bone conduction devices, where the coupling mass connects directly to the housing via a single suspension mechanism that is disposed in parallel with the actuator suspension mechanism.

Shown in FIG. 2A are microphones 126(A) and 126(B), which are located on housing 142. The microphones 126(A) and 126(B) operate by converting pressure fluctuations (i.e., sound waves) into electric current. As a result, the microphones 126(A) and 126(B) are susceptible to external sources of vibration. For example, if there is a path for vibration to be transmitted from the seismic mass actuator 150 to the microphones 126(A) and 126(B), then the gain which may be applied in the bone conduction device may be limited and, accordingly, the level of hearing loss which may be treated is limited (e.g., limit gain to prevent the occurrence of feedback). In the embodiment of FIG. 2A, the microphones 126(A) and 126(B) are substantially isolated from vibration generated by the seismic mass actuator 150 by the at least one housing suspension mechanism 162. That is, as described further below, the housing suspension mechanism 162 is used to attach the housing 142, and thus the microphones 126(A) and 126(B) to the seismic mass 152, but also operates as a mechanical vibration decoupling for the microphones 126(A) and 126(B) (i.e., limit the transfer of vibration, caused by the relative movement of the seismic mass 152 and the coupling mass 140 within the seismic mass actuator 150, to the microphones 126(A) and 126(B)).

In the arrangement of FIG. 2A, the housing suspension mechanism 162 is not only configured to support the housing 142 on which the microphones 126(A) and 126(B) are disposed, but it is also configured to decouple vibration at frequencies above the lowest operating frequency of the bone conduction device 100 (typically about 200 kHz). In particular, the housing suspension mechanism 162 is configured with properties (e.g. spring stiffness, damping coefficient, etc.) such that, when the seismic mass actuator 150 operates at frequencies above the resonance frequency of the suspension system (the system including the housing suspension mechanism and the mass supported by the housing suspension mechanism (e.g. the housing and any functional components rigidly coupled to the housing)), the suspension mechanism "decouples" the housing from the actuator system such that there is only a small transfer of vibration through the housing suspension mechanism to the housing 142 and, accordingly, to the microphones 126(A) and 126(B). The vibration transmission of a spring-mass system above the resonant frequency is low. In one example, the housing suspension mechanism 162 is configured so as to decouple vibration for frequencies above approximately 100 Hertz (Hz).

The housing suspension mechanism 162 is highly compliant in an axial direction of the actuator 150 so as to have limited impact on actuator dynamics (such as the resonant response of the actuator), and leading to the low resonant frequency which is outside the operating range of the bone conduct device. However, the housing suspension mechanism 162 is relatively stiff in a lateral direction. The axial direction of the actuator 150 (i.e., the primary direction of movement of the seismic mass and coupling mass) is represented in FIG. 2A by bi-directional arrow 164, while the lateral direction is represented in FIG. 2A by bi-directional arrow 166.

As shown in FIG. 2A, the housing 142, and accordingly the microphones 126(A) and 126(B), are indirectly supported by the coupling mass 140 via the seismic mass 152 and the housing suspension mechanism 162. That is, the coupling mass 140 only indirectly supports the housing 142. However, as noted above, the housing suspension mechanism 162 is configured so as to mechanically decouple the housing 142, and accordingly the microphones 126(A) and 126(B), from the vibration generated by the relative movement of the seismic mass 152 and the coupling mass 140. Stated differently, the microphones 126(A) and 126(B) are vibrationally isolated from the coupling mass 140, which is the component of the bone conduction device 100 that moves the most during generation of vibration.

As shown in FIG. 2A, the coupling shaft 145 of the coupling mass 140 passes through an aperture 170 in the housing 142 without making contact with the housing. Shown in FIG. 2A is at least one sealing member 172 that is configured to close the portion of the aperture 170 surrounding the coupling shaft in order to prevent contaminants (e.g., dirt or other debris) from entering the interior of the housing 142 through the aperture 170. The sealing member 172 is a highly compliant element that does not provide any structural rigidity or connection between the housing 142 and the coupling shaft 145.

As noted above, embodiments presented herein can be implemented with different types of transcutaneous bone conduction devices where the coupling mass operates with other types of anchor systems or without an anchor system. For example, in one arrangement, the coupling mass is configured to be held against the skin 132 of the recipient using an adhesive. In another example, the coupling mass 140 is configured to be held against the skin of the recipient using a clamping force generated by a structure extending to the opposite side of the head (e.g., via a headband arrangement). In other words, the embodiments presented herein may be applicable to a number of different types of skin-drive (passive transcutaneous) bone conduction devices, including passive transcutaneous system with implanted magnet(s) or non-surgical solutions that use a soft band, a headband/arch, or adhesive to couple a bone conduction device to a recipient, and/or other types of bone conduction devices, such as bone conduction glasses, etc.

Figure 2B:
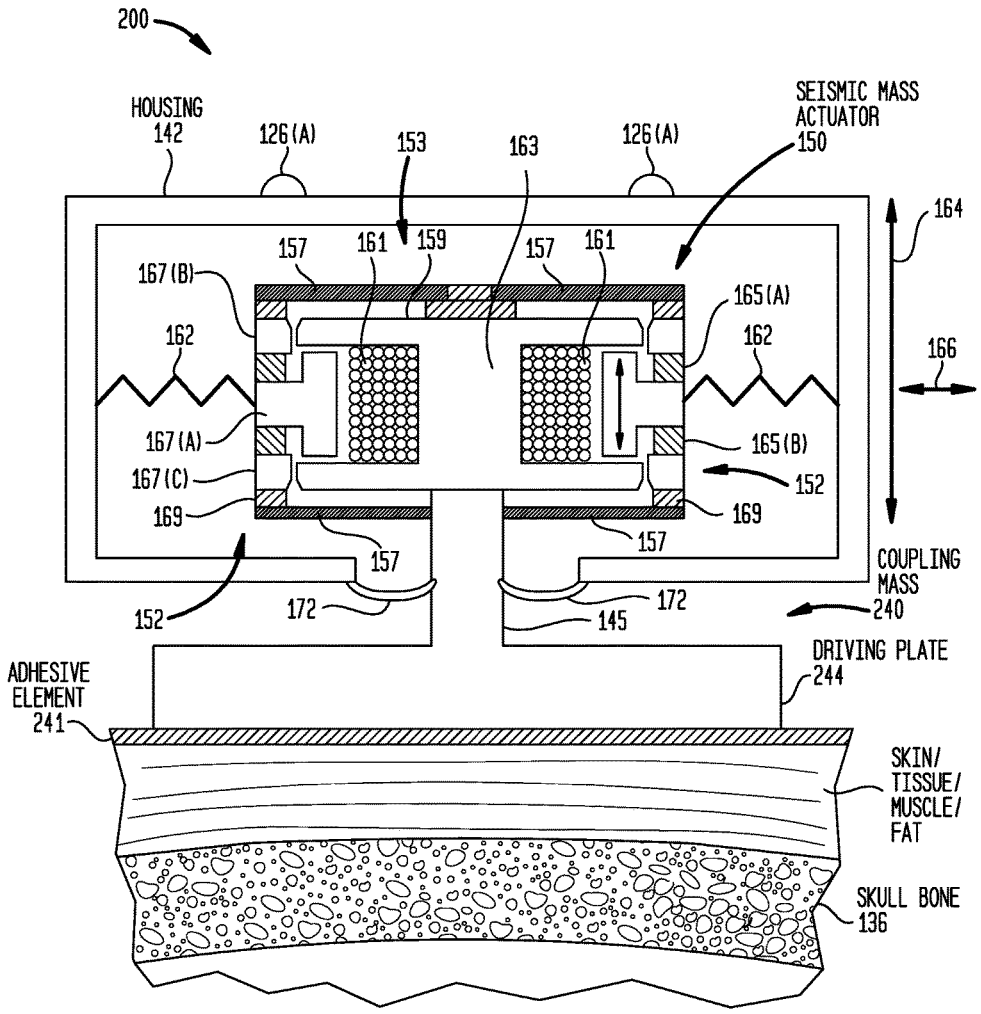

FIG. 2B is a schematic diagram illustrating the use of an adhesive element 241 in accordance with embodiments presented herein. In particular, shown in FIG. 2B is a bone conduction device 200 that is similar to bone conduction 100 of FIG. 2A. However, in this embodiment, the bone conduction device 200 includes a coupling mass 240 in which the driving plate 244 does not necessarily include permanent magnets. In addition, no implantable anchor system is present. Instead, the adhesive element 241 is configured to temporarily adhere the driving plate 244 to the recipient's skin. The coupling mass 240 is configured to be held in place by the adhesive element 241 so that the bone conduction device 200 can be worn on the recipient's head.

Figure 2C:
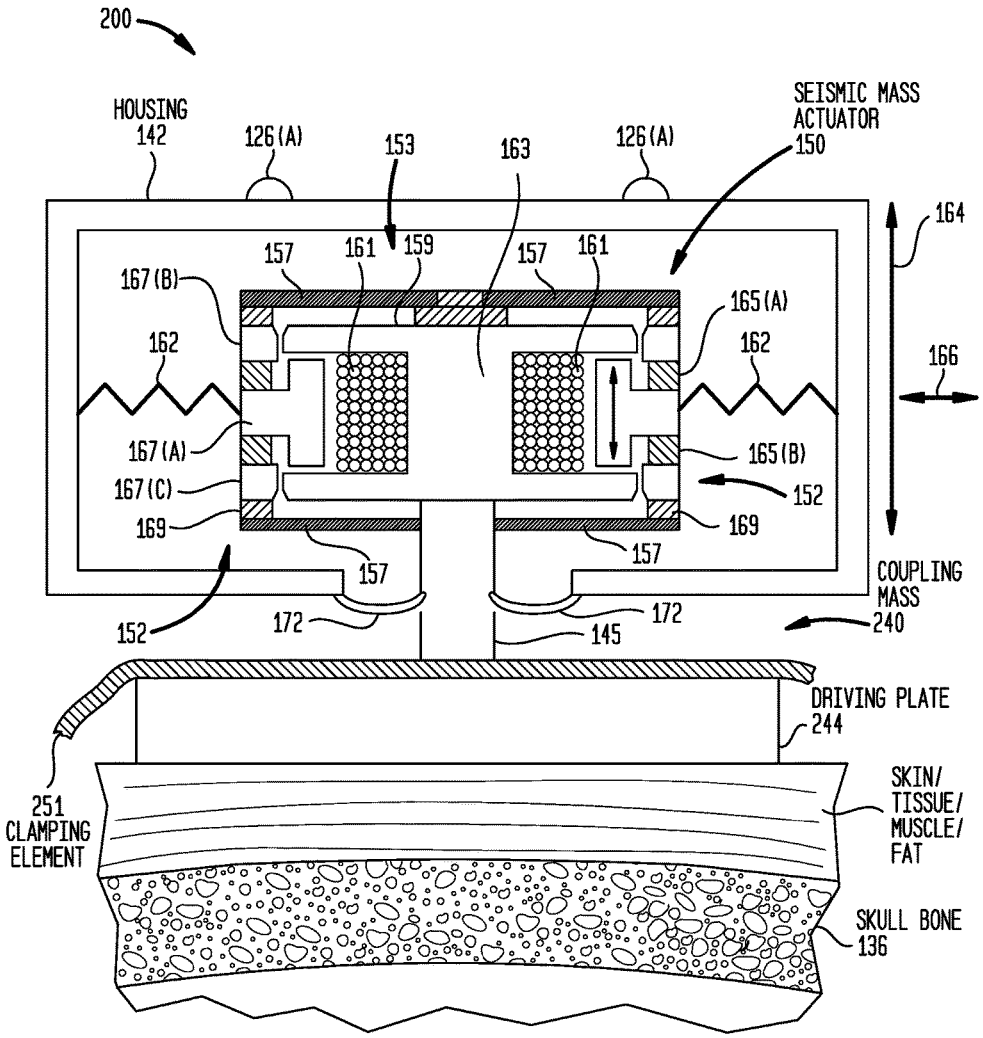

FIG. 2C is schematic diagram illustrating the use of a clamping element 251 in accordance with embodiments presented herein. In particular, shown in FIG. 2C is the bone conduction device 200 of FIG. 2B, which includes the coupling mass 240 as described above. In addition, no implantable anchor system is present. Instead, the clamping element 251 is configured to extend to the opposite side of the recipient's head (e.g., a headband) in order to apply a pressure to the driving plate 244. As such, the clamping element 251 holds the driving plate 244 against the skin of the recipient via a clamping force so that the bone conduction device 200 can be worn on the recipient's head.

FIGS. 2A-2C are schematic illustrations of a housing suspension mechanism that may be used in a bone conduction device in accordance with embodiments presented herein to suspend a housing from a seismic mass and, accordingly, isolate microphones disposed on the housing from vibration generated by a seismic mass actuator. FIGS. 3A, 3B, 4A, and 4B are schematic diagrams illustrating further details of example housing suspension mechanisms in accordance with embodiments presented herein. In FIGS. 3A, 3B, 4A, and 4B, various elements of the bone conduction devices, such as sound processors, amplifiers, etc., have been omitted for ease of illustration. It is also to be appreciated that the seismic mass actuators shown in FIGS. 3A, 3B, 4A, and 4B may operate in accordance with different actuation principles and, accordingly, may include a number of different components used to impart vibration to a recipient's skull. For ease of illustration, only the seismic masses of the seismic mass actuators in FIGS. 3A, 3B, 4A, and 4B have been shown. In specific arrangements, the seismic mass actuators of FIGS. 3A, 3B, 4A, and 4B are electromagnetic actuators that include a bobbin assembly that is surrounded by the seismic mass component. That is, the seismic mass components of FIGS. 3A, 3B, 4A, and 4B may have generally cylindrically shapes with a central opening in which the bobbin assembly is disposed.

Figure 3A:
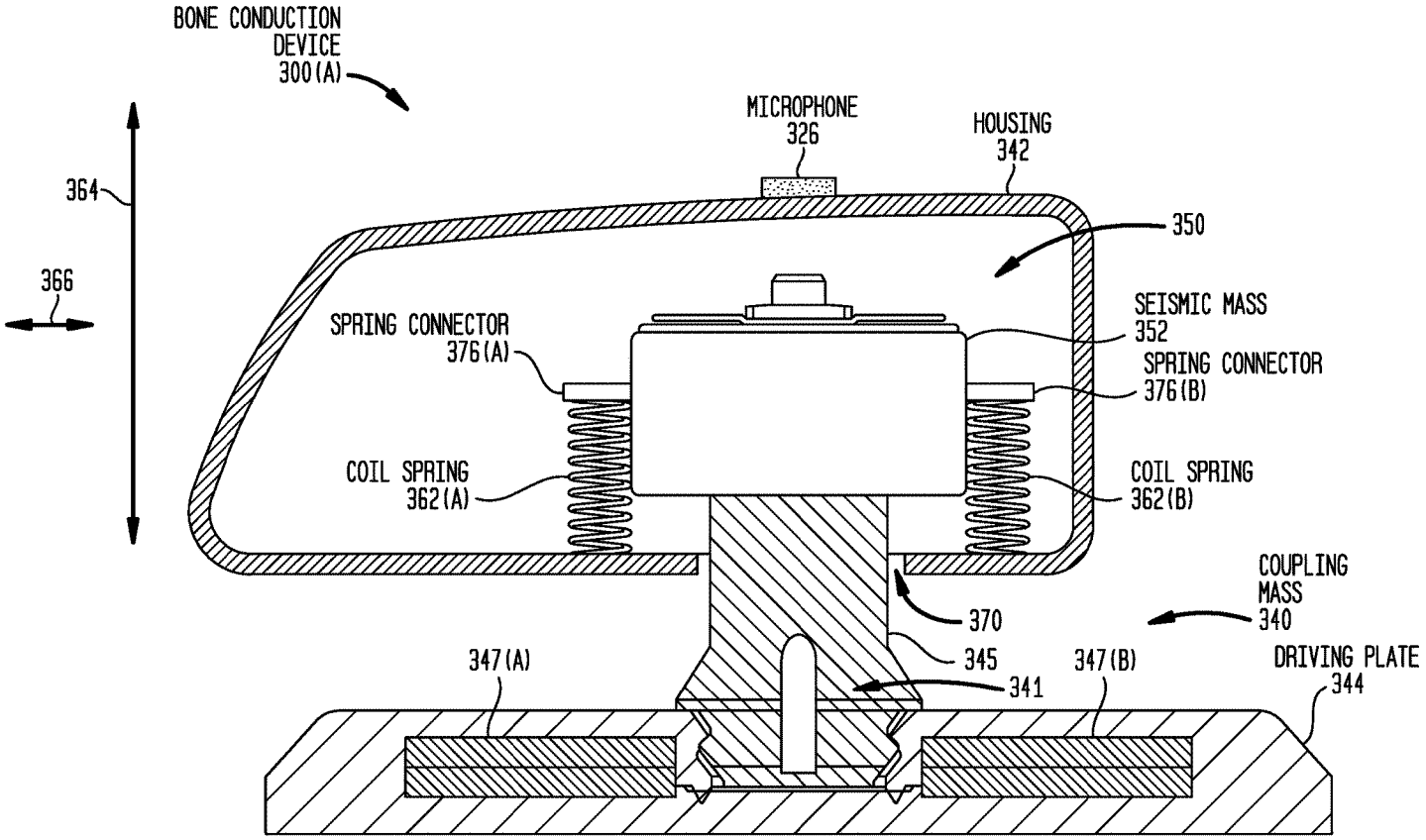
FIGS. 3A and 3B are simplified cross-sectional views of transcutaneous bone conduction device in which a microphone is suspended from a seismic mass of a seismic mass actuator via coil springs, in accordance in with an embodiment presented herein.

Referring first to FIG. 3A, shown is a cross-sectional view through the housing 342 of a transcutaneous bone conduction device 300(A). The bone conduction device 300(A) comprises a housing 342, a seismic mass actuator 350, and a coupling mass 340. Also shown is a microphone 326 disposed on the housing 342.

In the arrangement of FIG. 3A, the coupling mass 340 comprises a driving plate 344 and a coupling shaft 345. The driving plate 344 includes magnets 347(A) and 347(B) that are configured to be magnetically coupled to an implanted anchor system (not shown in FIG. 3A). Coupling mass 340 includes a coupling 341 in the form of a snap coupling configured to "snap couple" the shaft 345 to the driving plate 344. In the embodiment depicted in FIG. 3A, coupling 341 is located at a distal end of the coupling shaft 345. As shown in FIG. 3A, the driving plate 344 is mechanically linked to the seismic mass component 352 via the coupling shaft 345.

Similar to the embodiment of FIG. 2A, the seismic mass actuator 350 operates by generating a dynamic force (i.e., relative movement) between the seismic mass 352 and the coupling mass 240 that results in vibration that is transcutaneously transmitted to a recipient's skull bone. However, as noted, if excessive vibration is transmitted from the seismic mass actuator 350 to the microphone 326, then feedback can occur. As such, in the embodiment of FIG. 3A, the microphone 326 is substantially isolated from vibration generated by the seismic mass actuator 350 via a housing suspension mechanism formed by first and second coil springs 362(A) and 362(B). More specifically, the coil springs 362(A) and 362(B) operate to limit the transfer of vibration from the seismic mass actuator 350 to the housing 342 and, accordingly, limit the transfer of vibrations from the seismic mass actuator 350 to the microphone 326.

As shown, the coil springs 362(A) and 362(B) extend in an axial direction from spring connectors 376(A) and 376(B), which are each rigidly attached to the seismic mass 352, to an interior surface of the housing 342. That is, the coil springs 362(A) and 362(B) extend toward the portion of housing 342 that is adjacent to the opening 370. As such, the coil springs 362(A) and 362(B) support the housing 342 when the device is worn by a recipient by forming a structural connection between the housing and the coupling mass 340 (i.e., the housing is indirectly suspended from the coupling mass 340 via the actuator 350 and the coil springs).

However, as noted above, the coil springs 362(A) and 362(B) are configured to decouple the housing from vibration within the operating range of the device 300(A) (i.e. at frequencies above a lowest operating frequency of the bone conduction device 300(A)). In particular, the coil springs 362(A) and 362(B) are configured with properties such that, when the seismic mass actuator 350 operates at frequencies above the resonance frequency of the coil spring system (the system including the coil springs 362(A) and 362(B) and the mass supported by the suspension mechanism (e.g. the housing and any functional components rigidly coupled to the housing)), the coil springs "decouple" the housing from vibration such that there is only a small transfer of vibration through the coil springs 362(A) and 362(B) to the housing 342 and, accordingly, to the microphone 326. The majority of the absolute movement of the seismic mass 352 will be in the axial direction (normal to the skin surface), so this is the direction where the coil springs 362(A) and 362(B) have the highest compliance (i.e., the coil springs 362(A) and 362(B) are highly compliant in an axial direction of the actuator 350, but relatively stiff in a lateral direction). The axial direction of the actuator 350 (i.e., the primary direction of movement of the seismic mass and coupling mass) is represented in FIG. 3A by bi-directional arrow 364, while the lateral direction is represented in FIG. 3A by bi-directional arrow 366.

As shown in FIG. 3A, the housing 342, and accordingly the microphone 326, is indirectly supported by the coupling mass 340 via the seismic mass 352 and the coil springs 362(A) and 362(B). However, as noted above, coil springs 362(A) and 362(B) are configured so as to mechanically decouple the housing 342, and accordingly the microphone 326, from the vibrations generated by the relative movement of the seismic mass 352 and the coupling mass 340. Stated differently, the microphone 326 is mechanically isolated from the coupling mass 340 via the actuator 350 and the coil springs 362(A) and 362(B) (i.e., the microphone 326 is isolated from the coupling mass 340, which is the component of the bone conduction device 300(A) that moves the most during operation).

As shown in FIG. 3A, the shaft 345 of the coupling mass 340 passes through an aperture 370 in the housing 342 without making contact with the housing. Although not shown in FIG. 3A, a sealing member may be provided to close the portion of the aperture 370 surrounding the shaft 345 and thereby prevent contaminants (e.g., dirt or other debris) from entering the interior of the housing 342 through the aperture 370.

Figure 3B:
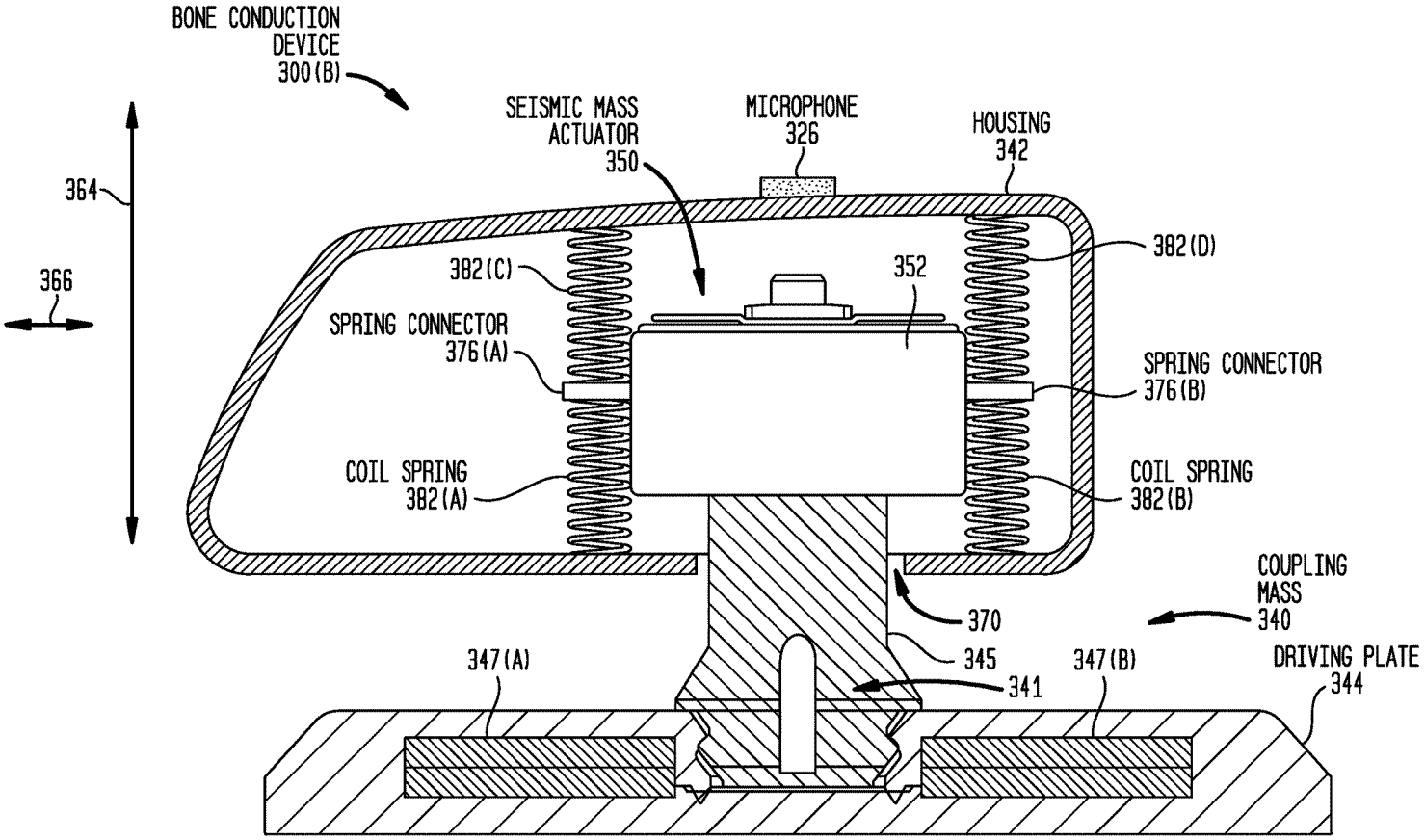

As noted, FIG. 3A illustrates an embodiment in which the suspension mechanism is formed by two coil springs 362(A) and 362(B) that each extend in the same general direction to an interior surface of housing 342. It is to be appreciated that other arrangements of coil springs may be used to form suspension mechanisms in accordance with embodiments presented herein. For example, FIG. 3B illustrates a transcutaneous bone conduction device 300(B) that is substantially similar to transcutaneous bone conduction 300(A) of FIG. 3A. However, in the embodiment of FIG. 3B, the bone conduction 300(B) includes a suspension mechanism formed by four (4) coil springs 382(A), 382(B), 382(C), and 382(D).

More specifically, the coil springs 382(A) and 382(B) extend in a first axial direction from spring connectors 376(A) and 376(B), which are each rigidly attached to the seismic mass 352, to a first interior surface of the housing 342. That is, the coil springs 382(A) and 382(B) extend toward the portion of housing 342 that is adjacent to the opening 370. However, the coil springs 382(C) and 382(D) extend in a second axial direction that is generally opposite from that of the coil springs 382(A) and 382(B). That is, the coil springs 382(C) and 382(D) extend from spring connectors 376(A) and 376(B) to a second interior surface of the housing 342 that is generally opposite to the opening 370.

Collectively, the coil springs 382(A), 382(B), 382(C), and 382(D) support the housing 342 when the bone conduction device 300(B) is worn by a recipient by forming a structural connection between the housing and the coupling mass 340 (i.e., the housing is indirectly supported by the coupling mass 340 via the actuator 350 and the coil springs). However, as noted above, the coil springs 382(A), 382(B), 382(C), and 382(D) are configured to decouple vibration at frequencies above a lowest operating frequency of the bone conduction device 300(B).

In certain embodiments, the coil springs 382(A), 382(B), 382(C), and 382(D) may each have substantially similar operating characteristics. In other embodiments, two or more of the coil springs may have different operating characteristics.

Again, it is to be appreciated that the two embodiments of FIGS. 3A and 3B are illustrative of the use of coil springs to form a suspension mechanism that couples microphones (e.g., indirectly via a housing) to a seismic mass of a seismic mass actuator and that other embodiments are within the scope of the embodiments presented herein. For example, other embodiments may make use of different numbers of coil springs, coil springs that extend in different directions (e.g., one or more coil springs extending in a lateral, rather than axial, direction), etc.

Figure 4A:
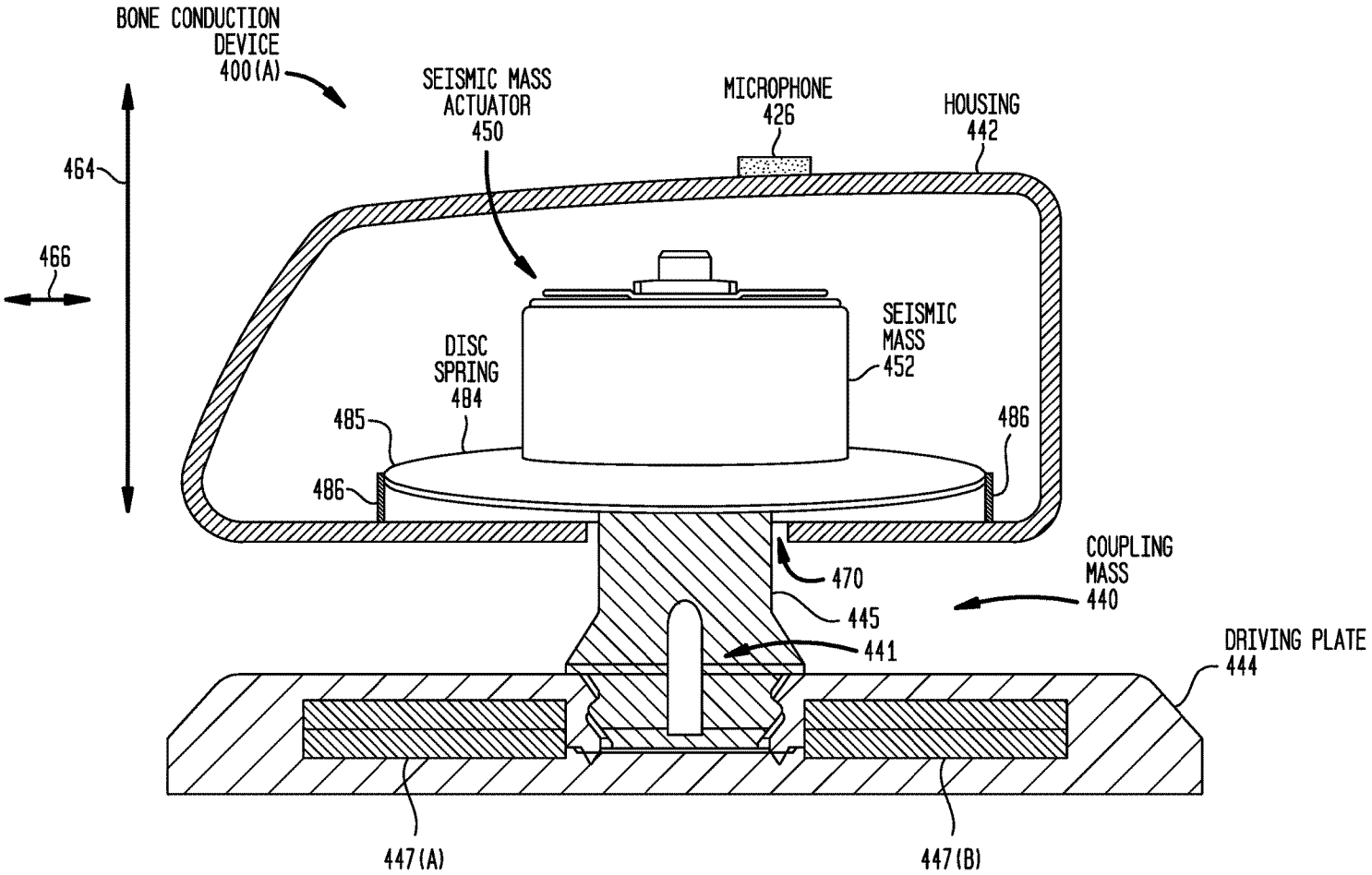
FIGS. 4A and 4B are simplified cross-sectional views of transcutaneous bone conduction devices in which a microphone is suspended from a seismic mass of a seismic mass actuator via disc springs, in accordance in with an embodiment presented herein.

FIG. 4A is a cross-sectional view of another transcutaneous bone conduction device 400(A) in accordance with embodiments presented herein. As shown, the bone conduction device 400(A) comprises a housing 442, a seismic mass actuator 450, and a coupling mass 440. Also shown is a microphone 426 disposed on the housing 442.

In the arrangement of FIG. 4A, the coupling mass 440 comprises a driving plate 444 and a coupling shaft 445. The driving plate 444 includes magnets 447(A) and 447(B) that are configured to be magnetically coupled to an implanted anchor system (not shown in FIG. 4A). Coupling mass 440 includes a coupling 441 in the form of a snap coupling configured to snap couple the shaft 445, and thus the actuator 450 and housing 442, to the driving plate 444. In the embodiment depicted in FIG. 4A, coupling 441 is located at a distal end of the coupling shaft 445.

Similar to the embodiment of FIG. 2A, the seismic mass actuator 450 operates by generating a dynamic force (i.e., relative movement) between the seismic mass 452 and the coupling mass 440 that results in vibration that is transcutaneously transmitted to a recipient's skull bone. However, if excessive vibration is transmitted from the seismic mass actuator 450 to the microphone 426, then feedback can occur. As such, in the embodiment of FIG. 4A, the microphone 426 is substantially isolated from vibration generated by the seismic mass actuator 450 via a suspension mechanism formed by a disc spring 484. The disc spring 484 operates to limit the transfer of vibration from the seismic mass actuator 450 to the housing 442 and, accordingly, limit the transfer of vibration from the seismic mass actuator 450 to the microphone 426.

As shown, the disc spring 484 is connected to, and extends radially from (i.e., in a lateral direction), an end of the seismic mass 452 that is located adjacent to the coupling shaft 445. Two or more portions of an outer edge 485 of the disc spring 484 are connected to interior housing extensions 486. The interior housing extensions 486 are rigid members that extend inwards from an interior surface of the housing 442. As such, an inner portion of the disc spring 484 is rigidly coupled to the seismic mass 452, while the outer edge 485 of the disc spring 484 is rigidly connected to the interior housing extensions 486 and, accordingly, to the housing 442. Although FIG. 4A illustrates the presence of housing extensions 486, it is to be appreciated that in other embodiments the outer edge 485 of the disc spring 484 may be connected directly to the housing 442 or the disc spring 484 could also, in certain arrangements, form a part of the outer housing wall.

In the arrangement of FIG. 4A, the disc spring 484 supports the housing 442 when the bone conduction device 400(A) is worn by a recipient by forming a structural connection between the housing and the coupling mass 440 (i.e., the housing is indirectly supported by the coupling mass 440 via the actuator 450 and the disc spring 484). However, as noted above, the disc spring 484 is configured to decouple vibration at frequencies above the lowest operating frequency of the seismic mass actuator 450. In particular, the disc spring 484 is configured with properties such that, when the seismic mass actuator 450 operates at frequencies above the resonance frequency of the disc spring system (the system including disc spring 484 and the mass supported by the disc spring 484 (e.g. housing 442 and any functional components rigidly coupled to the housing)), the disc spring "decouple" the housing 442 from vibration such that there is only a small transfer of vibration through the disc spring 484 to the housing 442 and, accordingly, to the microphone 426 (e.g., due to absorption and/or damping).

The disc spring 484 is highly compliant in an axial direction of the actuator 450, but relatively stiff in a lateral direction. The axial direction of the actuator 450 (i.e., the primary direction of movement of the seismic mass and coupling mass) is represented in FIG. 4A by bi-directional arrow 464, while the lateral direction is represented in FIG. 4A by bi-directional arrow 466.

As shown in FIG. 4A, the housing 442, and accordingly the microphone 426, is indirectly supported by the coupling mass 440, seismic mass 452, and the disc spring 484 when the bone conduction device 400(A) is worn by a recipient. However, as noted above, disc spring 484 is configured so as to mechanically decouple the housing 442, and accordingly the microphone 426, from the vibration generated by the relative movement of the seismic mass 452 and the coupling mass 440. Stated differently, the microphone 426 is mechanically isolated from the coupling mass 440 via the actuator 450 and the disc spring 484 (i.e., the microphone 426 is isolated from the coupling mass 440, which is the component of the bone conduction device 400(A) that moves the most during operation).

As shown in FIG. 4A, the shaft 445 of the coupling mass 440 passes through an aperture 470 in the housing 442 without making contact with the housing. Although not shown in FIG. 4A, a sealing member may be provided to close the portion of the aperture 470 surrounding the shaft 445 and thereby prevent contaminants (e.g., dirt or other debris) from entering the interior of the housing 442 through the aperture 470.

Figure 4B:
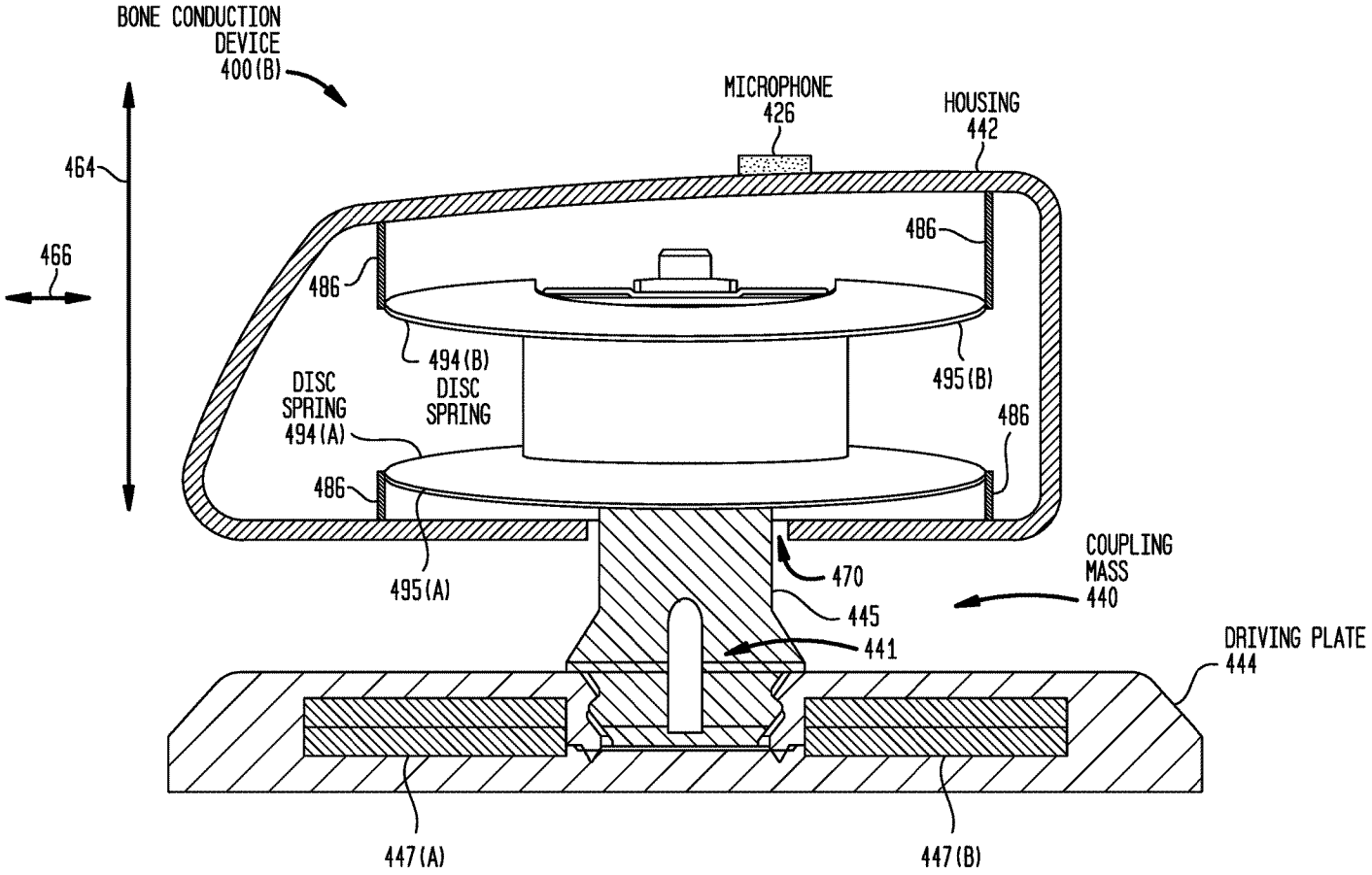

As noted, FIG. 4A illustrates an embodiment in which the suspension mechanism is formed by a disc spring 484 that extends radially from an end of the seismic mass 452 that is located adjacent to the coupling shaft 445. It is to be appreciated that other arrangements of disc springs may be used to form suspension mechanisms in accordance with embodiments presented herein. For example, FIG. 4B illustrates a transcutaneous bone conduction 400(B) that is substantially similar to transcutaneous bone conduction 400 (A) of FIG. 4A. However, in the embodiment of FIG. 4B, the bone conduction 400(B) includes a suspension mechanism formed by two disc springs 494(A) and 494(B).

More specifically, a first disc spring 494(A) extends radially from a first end of the seismic mass 452 that is located adjacent to the coupling shaft 445. However, a second disc spring 494(B) extends radially from a second opposing end of the seismic mass 452. As shown, an inner portion of each of the disc springs 494(A) and 494(B) is rigidly coupled to the seismic mass 452, while the outer edge 495(A) and 495(B) of each of the disc springs 494(A) and 494(B), respectively, is rigidly connected to interior housing extensions 486 and, accordingly, to the housing 442. Although FIG. 4B illustrates the presence of housing extensions 486, it is to be appreciated that in other embodiments the outer edges 495(A) and 495(B) of the disc springs 494(A) and 494(B), respectively, may be connected directly to the housing 442.

Collectively, the disc springs 494(A) and 494(B) support the housing 442 when the bone conduction device 400(A) is worn by a recipient by forming a structural connection between the housing and the coupling mass 440 (i.e., the housing is indirectly supported by the coupling mass 440 via the actuator 450 and the disc springs). However, as noted above, the disc springs 494(A) and 494(B) are configured to decouple vibration at frequencies above a lower operating frequency of the seismic mass actuator 450.

In certain embodiments, the disc springs 494(A) and 494(B) may each have substantially similar operating characteristics. In other embodiments, the disc springs 494(A) and 494(B) may have different operating characteristics.

Again, it is to be appreciated that the two embodiments of FIGS. 4A and 4B are illustrative of the use of disc springs to form a suspension mechanism that couples microphones (e.g., indirectly via a housing) to a seismic mass of a seismic mass actuator and that other embodiments are within the scope of the embodiments presented herein. For example, other embodiments may make use of different numbers of disc, disc springs that extend from different locations, etc.

As noted above, aspects presented herein are directed to transcutaneous bone conduction devices (e.g., skin drive devices) in which the microphone(s) is/are suspended from the seismic mass component of the actuator by a suspension mechanism. The techniques presented herein substantially isolate the microphones from vibration generated by the seismic mass actuator so as to provide improved feedback performance. As noted, in certain examples, the microphone(s) are indirectly coupled to the seismic mass via the housing. That is, the housing is coupled to the seismic mass and the microphones are supported by the housing. Such arrangements in which the seismic mass of the actuator is coupled to the housing can potentially reduce the risk of air pressure building up inside the device, and thereby also the risk of feedback.

It is to be appreciated that the embodiments presented herein are not mutually exclusive.

The invention described and claimed herein is not to be limited in scope by the specific preferred embodiments herein disclosed, since these embodiments are intended as illustrations, and not limitations, of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed is:

1. A transcutaneous bone conduction device, comprising:
- a microphone;
- a housing;
- a coupling mass configured to be attached to a recipient;
- a seismic mass actuator configured to generate vibration for delivery to the recipient based on the sound signals received at the microphone, wherein the actuator comprises a seismic mass configured for relative movement with the coupling mass to generate the vibration; and
- at least two suspension mechanisms connected in series between the housing and the coupling mass.

2. The transcutaneous bone conduction device of claim 1, wherein a least one of the two suspension mechanisms comprises one or more coil springs.

3. The transcutaneous bone conduction device of claim 1, wherein at least one of the two suspension mechanisms comprises one or more disc springs.

4. The transcutaneous bone conduction device of claim 1, wherein the bone conduction device is a skin drive device.

5. The transcutaneous bone conduction device of claim 1, wherein the coupling mass includes one or more permanent magnets configured to secure the transcutaneous bone conduction device to an implanted anchor system via a transcutaneous magnetic field.

6. The transcutaneous bone conduction device of claim 1, further comprising:
- an adhesive element configured to secure the transcutaneous bone conduction device and the coupling mass to the skin of the recipient.

7. The transcutaneous bone conduction device of claim 1, further comprising:
- a clamping element extending around a portion of the head of the recipient, wherein the clamping element is configured to generate a clamping force to retain the coupling mass against the skin of the recipient.

8. The transcutaneous bone conduction device of claim 1, wherein the microphone is coupled to the housing.

9. The transcutaneous bone conduction device of claim 1, wherein the seismic mass actuator comprises:
- first and second actuator subassemblies configured for relative movement in order to impart the vibration to the recipient,
- wherein the first actuator subassembly comprises a bobbin and the second actuator subassembly comprises the seismic mass.

10. The bone conduction device of claim 9, wherein the seismic mass is coupled to the bobbin by at least one of the two suspension mechanisms.

11. The bone conduction device of claim 10, wherein the housing is mechanically coupled to the seismic mass by the other of the at least one of the two suspension mechanisms.

12. The bone conduction device of claim 1, wherein the coupling mass is configured to be held against the skin of a recipient, and the bone conduction device is configured so that movement of the seismic mass relative to the coupling mass to generate the vibration causes the coupling mass to more, relative to the recipient's skin, than the seismic mass.

13. A passive transcutaneous bone conduction device, comprising:
- a housing;
- an actuator disposed within the housing and configured to generate vibration for delivery to a recipient; and
- a coupling mass connected to the actuator and configured to be held against the skin of a recipient to deliver the vibration from the actuator to the recipient,
- wherein there are at least two suspension mechanisms disposed in series between the coupling mass and the housing.

14. The transcutaneous bone conduction device of claim 13,
- wherein the actuator comprises an output assembly and a seismic mass assembly, and
- wherein the actuator generates the vibration for delivery to the recipient via relative movement of the seismic mass assembly and the output assembly.

15. The passive transcutaneous bone conduction device of claim 14, wherein a first suspension mechanism of the at least two suspension mechanisms connects the seismic mass assembly of the actuator to the output assembly of the actuator.

16. The passive transcutaneous bone conduction device of claim 15, wherein a second suspension mechanism of the at least two suspension mechanisms connects the seismic mass assembly of the actuator to the housing.

17. The passive transcutaneous bone conduction device of claim 13, wherein a first suspension mechanism of the at least two suspension mechanisms is disposed within the actuator, and the second suspension mechanism of the at least two suspension mechanisms connects the actuator to the housing.

18. The passive transcutaneous bone conduction device of claim 13, further comprising a microphone disposed on the housing and vibrationally isolated from the coupling mass by the at least two suspension mechanisms.

19. The bone conduction device of claim 13, wherein the coupling mass is configured to be held against the skin of a recipient by at least one of: an adhesive element, a magnetic coupling and a structure supported by the anatomy of a recipient.

20. The bone conduction device of claim 14, wherein the bone conduction device is configured so that movement of the seismic mass assembly relative to the output assembly to generate the vibration causes the coupling mass to more, relative to the recipient's skin, than the seismic mass.

* * * * *